United States Patent [19]

Acker

[11] 4,292,698

[45] Oct. 6, 1981

[54] CONVERTIBLE SOFA-BED WITH BACK RESTRAINING MECHANISM

[75] Inventor: Donald J. Acker, Elkhart, Ind.

[73] Assignee: J. F. Enterprises, Inc., Wakarusa, Ind.

[21] Appl. No.: 68,632

[22] Filed: Aug. 22, 1979

[51] Int. Cl.[3] ..... A47C 17/00; A47C 1/00

[52] U.S. Cl. ..... 5/45; 5/46 R; 5/59 R; 297/216

[58] Field of Search ..... 297/379, 216, 478, 487, 297/488; 296/65 A; 5/37 R, 44–47

[56] References Cited

U.S. PATENT DOCUMENTS

| | | | |
|---|---|---|---|
| 3,918,658 | 11/1975 | Belles | 297/478 |
| 4,045,079 | 8/1977 | Arlauskas et al. | 297/216 |
| 4,063,377 | 12/1977 | Takada | 297/478 |
| 4,110,855 | 9/1978 | Acker | 5/45 |

*Primary Examiner*—Casmir A. Nunberg
*Attorney, Agent, or Firm*—Marmaduke A. Hobbs

[57] ABSTRACT

A convertible sofa-bed unit for a vehicle in which a back section is mounted on a seat section and is moveable from an upright position near the rear of the seat section to a horizontal position in front of the seat section, and a device is provided for preventing the movement of said back toward the forward edge of the seat in response to a sudden forward lurching of the back section. The strap is preferably connected at one end to the rear of the back section near the upper edge thereof and is wound on a ratchet controlled reel preferably disposed beneath the rear edge of the seat section, and an inertia responsive device prevents unreeling of the strap when the sudden forward lurching of the back section occurs momentarily.

4 Claims, 7 Drawing Figures

CONVERTIBLE SOFA-BED WITH BACK RESTRAINING MECHANISM

A type of convertible sofa-bed unit which is extensively used in campers, vans and similar types of vehicles consists of an elongated seat and a back which is so supported that it can be easily pulled forwardly from its upright back position to a horizontal bed position in front of the seat. In some of these sofa-beds the back is supported in front of the seat by legs which unfold when the unit is converted to a sofa, and in other types of units the back does not have legs but is supported solely by arms attached to the sofa-bed structure at each end. The latter type is particularly advantageous in recreational vehicles, since there are no legs to interfere with other equipment in the vehicle and no floor or other support in front of the unit must be provided for supporting the back when it is in its horizontal position. Both types of these convertible sofa-beds perform and operate satisfactorily when properly installed in the vehicle. Since both the leg and legless types of convertible sofa-beds have backs which swing forwardly from a vertical position on the seat to a horizontal position in front of the seat to form the bed, there is a tendency for the back to be propelled forwardly from its vertical position on the seat when the vehicle is suddenly braked, if the sofa-bed is positioned crosswise of the vehicle. This can create a hazard to anyone in the vicinity of the sofa-bed, since the back may be thrown into a person, causing an injury by the blow and/or causing the person to lose his balance and fall forwardly in response to the decreasing momentum of the vehicle. This hazardous condition obviously does not exist when the sofa-bed unit is placed along either side of the vehicle compartment or when it is facing rearwardly. Latches which can be manually released could be used to retain the back in its vertical position on the seat; however, releasing the latch each time the bed is made up would be inconvenient and would be unsuited in many installations, in that the latches could only be reached for operation with difficulty, since the sofa-beds are often placed in confined areas where the vehicle walls, cabinets or vehicle appurtenances would interfere with reaching and operating the latch to release the back so that it could be moved to its forward horizontal position. Further, the mechanical latch parts could form objects capable of injuring the person using or operating the sofa-bed unit. It is therefore one of the principal objects of the present invention to provide a convertible sofa-bed unit of the aforesaid type having a restraining mechanism which prevents the back from being accidentally propelled forwardly when the vehicle is braked or otherwise decelerated, but which does not restrain the forward movement of the back when it is being intentionally moved from its vertical position on the seat to its horizontal position in front of the seat.

Another object of the invention is to provide a convertible sofa-bed unit having a back which remains in its vertical upright position on the rear edge of the seat unless intentionally moved, and which can be moved to its bed position in front of the seat without releasing or manipulating any latches or levers to release the back for the intentional forward movement to the bed position.

Still another object of the invention is to provide a mechanism for restraining accidental movement of the back of a convertible sofa-bed unit of the aforesaid type from its upright position along the rear edge of the seat, yet which permits the free movement of the back to its bed position along the forward edge of the seat.

A further object is to provide a convertible sofa-bed unit having a back restraining mechanism which is activated by inertia resulting from the sudden forward movement of the back when the vehicle is braked or otherwise rapidly decelerated, but remains inoperable to restrain the movement of the back when the vehicle is parked, and which forms a restraining member for the occupant or occupants of the bed when the back is in its horizontal position along the front edge of the seat.

Additional objects and advantages of the present invention will become apparent from the following description and accompanying drawings, wherein.

Referring more specifically to the drawings, numeral 10 indicates generally the present sofa-bed unit, consisting of a seat section 12 and a back section 14, the seat section being shown mounted on leg frames 16 and 18 attached to the bottom of the seat section near the front and back of the section. Various other types of supporting structures for the seat section can be used, and may consist of a box or chest-like structure having an enclosure to which the seat is hinged along the rear edge to permit the front edge of the seat to be lifted to gain entrance to the compartment in the box or chest for use in storing blankets, sheets and other bed clothing. The seat section may be of a variety of different constructions, but normally consists of a rigid metal or wood frame having a steel spring construction with padding, such as foam rubber, thereon, covered by suitable upholstery. These are details which can be varied in accordance with the intended use of the sofa-bed unit, depending on where the unit would be used and in accordance with the decor of the vehicle in which the unit is to be installed. The present sofa-bed unit is intended primarily for use in recreational vehicles such as campers, vans, motor homes, cabin cruisers and the like, where space is at a premium and safety to the occupants while the vehicle is traveling is of major importance; however, the sofa-bed unit can be used in other types of structures. When used in the vehicle, the legs are not only securely attached to the underside of the seat but are also firmly secured to the vehicle structure so that the sofa-bed unit will remain in place during acceleration and deceleration of the vehicle, including sudden stops thereof.

Figure 1:
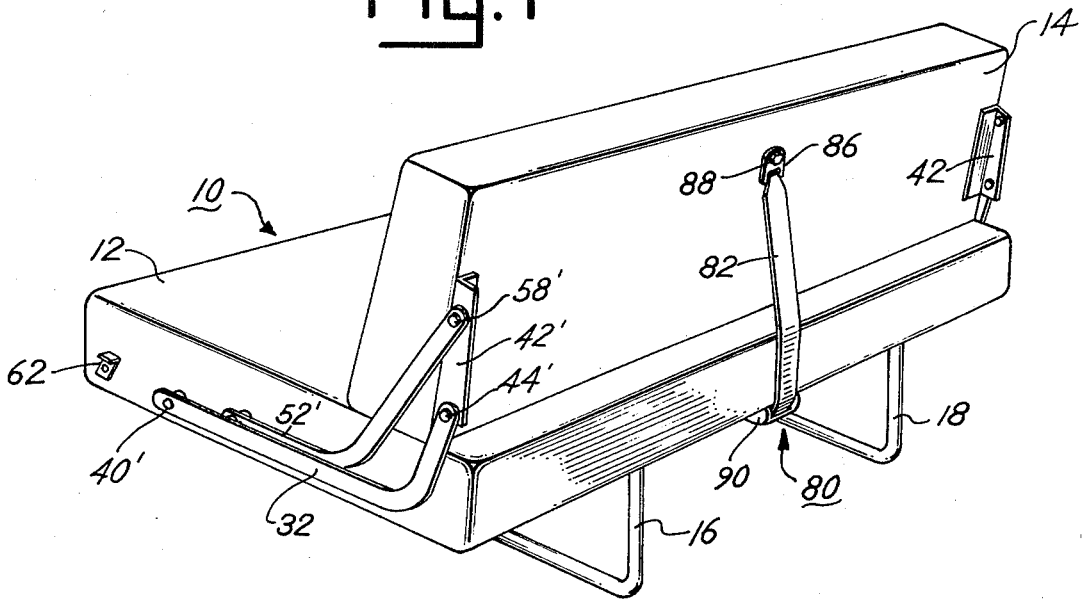
FIG. 1 is a perspective view of the present convertible sofa-bed unit showing the back and one end thereof, with the back in the sofa position.
Figure 2:
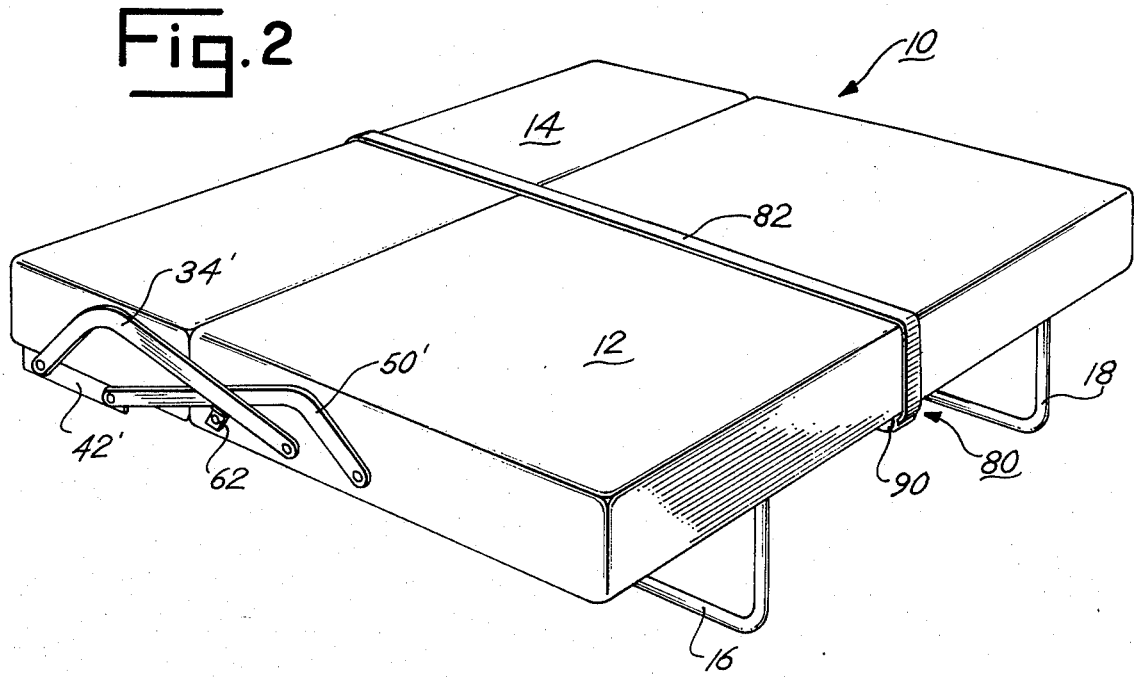
FIG. 2 is a perspective view of the convertible sofa-bed unit shown in FIG. 1 with the sofa-bed unit in the bed position.
Figure 3:
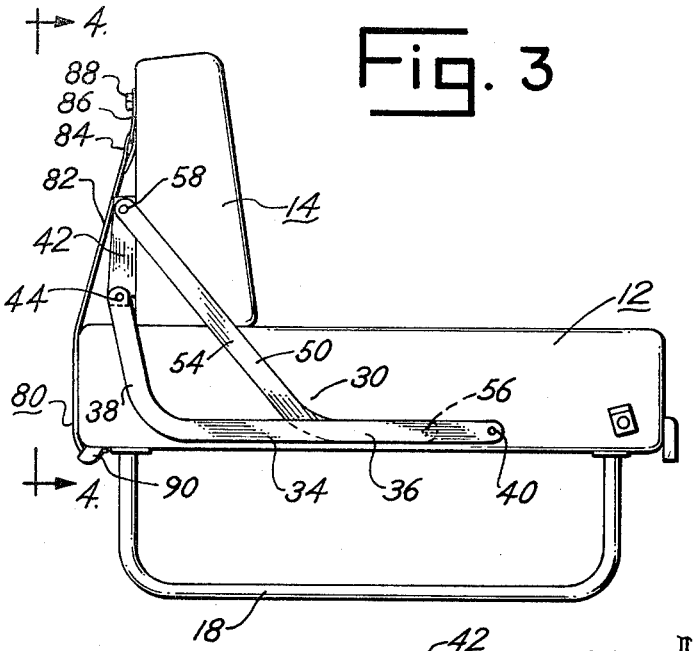
FIG. 3 is an end elevational view of the end of the sofa-bed unit shown in FIG. 1, the end seen being opposite the one seen in FIG. 1.
Figure 4:
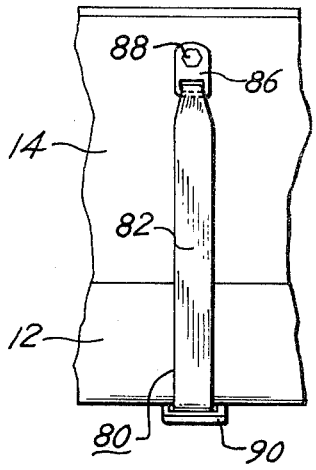
FIG. 4 is a fragmentary elevational view of a portion of the rear of the back and seat section.
Figure 6:
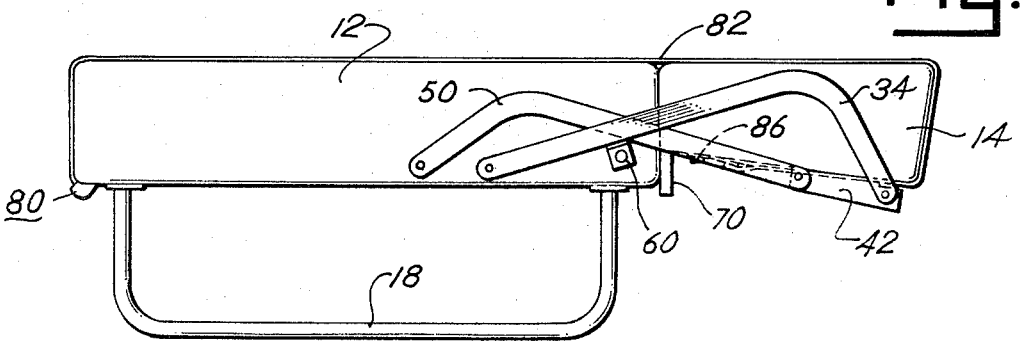
FIG. 6 is an elevational view of the end of the sofa-bed unit showing the position of the back of the sofa-bed unit when the sofa-bed unit is in the bed position.

The back rests on the seat cushion and is shifted between the sofa position shown in FIGS. 1 and 3 and the bed position shown in FIGS. 2 and 6 by operating mechanisms 30 and 32 at opposite ends of the unit, the two operating mechanisms being essentially identical to one another with respect both to construction and to operation. Hence, only one will be described in detail herein, with like numerals with primes identifying the respective parts on the other mechanism.

Mechanism 30 consists of an arm 34 having a generally horizontal member 36 and an upright member 38 joined integrally to member 36 at substantially a right angle, member 36 being connected to the frame or seat section 12 by a pin or screw 40, and by a pin 44 to a bracket 42 secured to the frame along the lower portion of back section 14. A second arm 50 is provided, having a generally horizontal member 52 and a member 54 integrally joined to member 52 and extending angularly upwardly to the back, member 52 being pivotally secured to the frame of the seat section 12 by a pin 56 and to the frame of the back section by a pin 58 at a point above the upper end of arm 34. The description with reference to horizontal and vertical positions of the two arms as thus far used, has applied to the sofa-bed unit in the sofa position. The operating mechanisms 30 and 32 rotate the back section as it is pulled forward, in a single operation, from the position shown in FIG. 1 to the position shown in FIG. 2, in the manner best illustrated in FIG. 5, with the mechanisms 30 and 32 providing full support for the back during the complete movement between the two positions.

When the foregoing operation from the sofa position to the bed position has been completed, the arms of the mechanisms are in a generally horizontal position. In this position, members 36 and 36' of arms 34 and 34' are supported by brackets 60 and 62 secured to the frame of the seat section adjacent the respective forward corners. With arms 34 and 34' supported by brackets 60 and 62, the arms effectively support the forward edge of the back section when it is in the bed position, as illustrated in FIGS. 2 and 6. Arms 50 and 50' extend to a point approximately half-way between the forward and rearward edges of the back while the back section is in the bed position, to give additional support and stability to the back when it is in the bed position. In this position arms 50 and 50' may likewise be supported by brackets 60 and 62, respectively. To assure the proper positioning and effective support of the back section when it is in the bed position, a strip 70 forming an elongated bracket and preferably upholstered, is disposed along the lower front edge of the seat section and supports the rear edge of the back when the back is in the bed position, so that the upper surface of the back, when in this position, is effectively maintained on a plane with the upper surface of the cushion of the seat section. With the two arms at each end in the position shown in FIGS. 2 and 6, and with arms 34 and 34' being supported by brackets 60 and 62 and the back section being supported by strip 70, the back section is retained in its horizontal bed position without the need for any further support, such as legs extending downwardly from the back to the floor. This structure permits the bed to be used in a limited space without legs or other additional support means which could interfere with the folding and unfolding of the bed, and without the necessity of providing a floor or other uniform supporting structure beneath the back section while it is in the bed position. However, in some instances, where a wall or other permanent structural features are in close proximity to the back when it is in the bed position, a bracket or a fixture may be provided on the structural features for providing additional support for the back section.

One of the hazards of the present sofa-bed of the general type illustrated in the drawings is that, when the unit is placed horizontally across the vehicle facing forwardly, the back may be thrown forwardly when the vehicle stops suddenly. Such a movement of the back can result in injury to the occupants, particularly if the back is thrown against the occupants of the vehicle. Further, the back may tend to propel the occupants of the vehicle forwardly, due to the momentum and inertia of the back as it is thrown forwardly. In the present unit this type of hazard is eliminated by the use of a restraining mechanism indicated generally by numeral 80, consisting of a strap 82 attached at its upper end 84 to a fixture 86 secured to the frame of the back section by a bolt or screw 88. The strap is connected at its lower end to an anchor device indicated generally by numeral 90, which is secured to the underside of the seat, the device being bolted to the frame of the seat so that it will be securely held to the seat section. The device includes a reel and a ratchet mechanism operated by inertia or centrifugal force produced by sudden unwinding of the strap from the reel. This ratchet immediately becomes operable and prevents the strap from unwinding further, thereby preventing any substantial movement of back section 14 forwardly. As soon as the sudden movement has ceased, the ratchet is released and the back section can be pulled forwardly at a moderate speed with no interference from the restraining mechanism 80. When the back section is pulled forwardly, the strap unwinds from the reel, permitting the back section to move to its full bed position as illustrated in FIGS. 2 and 6. With the back section in the horizontal position shown in FIG. 6 at the front edge of the seat section, the strap passes over the top of the two sections and beneath the horizontally positioned back section to fixture 86, thereby not interfering with the use of the sofa as a bed since the strap lies flat across the top of the back and seat sections in the position shown in FIGS. 2 and 6.

Figure 7:
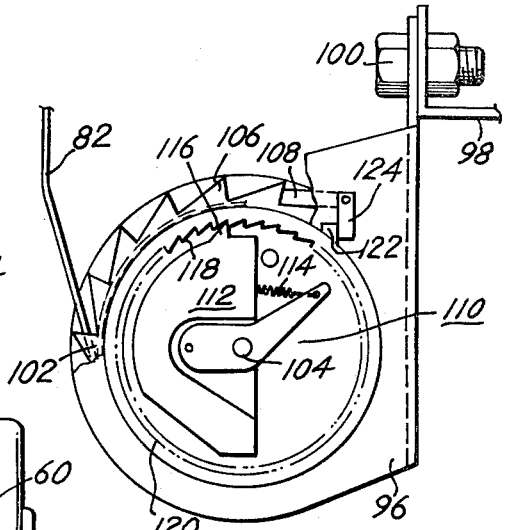
FIG. 7 is a cutaway view of a restraining mechanism for the back of the sofa-bed unit.

While restraining mechanism 80 may be of various types, one suitable type is illustrated in FIG. 7. Frame 96 of the mechanism is anchored to the frame member 98 of the seat section by a bolt 100. The type illustrated in FIG. 7 consists of frame 96 and a reel 102 mounted on a shaft 104 journalled in frame 96. The reel has a pair of spaced flanges which have a series of teeth extending around the entire periphery thereof. A pawl 108 operated by inertia assembly 110 restrains the reel when the back section 14 suddenly lurches forwardly. This forward lurch causes a sudden jerk on strap 82 and immediate rotation of the reel. An inertia assembly includes a centrifugal weight 112 rotated by shaft 104. When the weight overcomes the effect of spring 114, a tooth 116 on the weight engages one of the annular series of teeth 118 on wheel 120, causing the wheel to rotate and lug 122 to engage arm 124 of pawl 108. The pawl engages teeth 106 and holds the reel against further rotation and the strap against further unwinding of the reel. When a sudden forward movement occurs, the back is retained in its upright position and is not propelled forwardly. When the force tending to propel the seat rapidly forwardly ceases, spring 114 acting on weight 112 disengages tooth 116 from teeth 118, thus permitting wheel 120 to yield and release pawl 108 from teeth 106. The reel is free to rotate when the back section is moved at a slow or moderate speed forwardly, as when the back section 14 of the sofa-bed is moved from the sofa position to its bed position.

Figure 5:
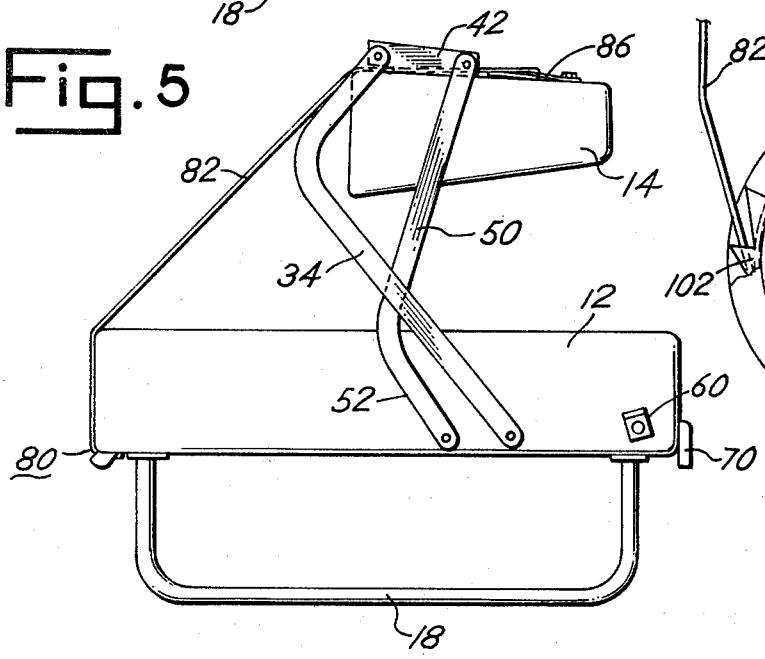
FIG. 5 is an elevational view of the same end as that shown in FIG. 3, illustrating the manner in which the sofa-bed unit is converted between the sofa and seat position.

In the operation of the present convertible sofa-bed unit, to convert the unit between the two positions, starting with the unit in the position shown in FIG. 1, back section 14 is pulled forwardly, and, under the control of mechanisms 30 and 32, the back section is rotated in a clockwise direction as seen in FIG. 5, from the position at which the front of the back section faces forwardly to a position where the front faces upwardly as seen in FIG. 2. When the unit is in the bed position, arms 34 and 50 engage bracket 60, and arms 34' and 50' engage bracket 62, and the rear edge of the back section engages strip 70, as the back section reaches its horizontal position in front of the seat section. Thus a firm support is provided for the back section when it is in the bed position without the need for any additional support, such as legs beneath the back. The sofa-bed unit is now sufficiently large that two adults can sleep comfortably on the unit. When the unit is to be returned to its sofa position, the back is merely lifted and, as it is pushed backward, it automatically rotates in a counterclockwise direction, as seen in FIG. 6, to place the back section in the position shown in FIGS. 1 and 3, with the back section being firmly supported by the seat section and being held in its substantially vertical position by arms 50 and 50'.

The restraining mechanism 80 is not only essentially concealed when the back is in its upright position as illustrated in FIGS. 1 and 3, but it does not interfere with the movement of the back from the vertical position through the rotating movement illustrated in FIG. 5 to the horizontal bed position seen in FIG. 6. However, a sudden forward movement or jerk of the back activates the restraining mechanism as a result of inertia and/or centrifugal force to prevent further forward movement of the back. In the embodiment illustrated in FIG. 3, the strap is connected near the top of the back; however, it would restrain the movement of the back forwardly if it were positioned near the center or lower part of the back, although a more effective restraining action is obtained by positioning fixture 86 near the upper edge of the back. Further, the mechanism 90 shown mounted beneath the rear of the seat section can be mounted along the rear edge of the seat section, provided it is firmly secured to the frame of the section or to some other anchoring structure in that general area.

It is seen that the present sofa-bed with the back restraining mechanisms can be installed in various positions in the vehicle and be safely used therein without danger of the back's being propelled forwardly when the vehicle stops suddenly. However, the restraining mechanism permits the sofa-bed to be readily converted between the sofa and bed positions without any interference from the restraining mechanism when the back is moved at a normal rate from the sofa to the bed position. Further, the strap may be used when the unit is in the bed position to restrain the occupants of the bed in the event the sofa-bed unit is being used while the vehicle is traveling. The strap can be placed over the occupants, preferably over the bed covering, and will restrain the occupants in the event of a sudden stop, without causing undue pressure on the occupants when the vehicle is traveling at a constant speed or is slowly decelerated.

While only one embodiment of the present convertible sofa-bed unit with a back restraining mechanism thereon has been described in detail herein, various changes may be made without departing from the scope of the invention.

I claim:

1. A convertible sofa-bed unit for a vehicle comprising an elongated, horizontal seat section, a supporting frame for said seat section, a back section positioned vertically upwardly from the rear of said seat section in a sofa position and being moveable from said position to a horizontal position along the forward edge of said seat section with the front of the back facing upwardly in a bed position and being on a plane with the top surface of the seat section and with the bottom of the back facing forwardly, and a back section restraining device having a strap connected at one end to the rear of said back section near the top thereof when the back section is in its sofa position and lying over the upper surfaces of the seat and back sections when the back section is in its bed position, a reel mounted on said seat section near the rear thereof and connected to the other end of said strap, and means for preventing the rotation of said reel upon sudden forward lurching of said back section and thereby preventing movement of said back section from its vertical position on the rear of said seat section.

2. A convertible sofa-bed unit as defined in claim 1 in which said restraining device includes a ratchet and an inertia responsive element for actuating said ratchet.

3. A convertible sofa-bed unit as defined in claim 1 in which arms disposed at the two ends of said seat and back section and connected thereto rotate said back section from a position where the front of said back section faces forwardly when the unit is in the sofa position to a position where said front is facing upwardly when said back section is in the bed position.

4. A convertible sofa-bed unit as defined in claim 1 in which said device for preventing operation of said reel includes a mechanism which is inertia responsive.

* * * * *